US006046515A

United States Patent [19]

Lewis

[11] Patent Number: 6,046,515

[45] Date of Patent: Apr. 4, 2000

[54] PROCESS AND APPARATUS FOR PREVENTING OXIDATION OF METAL

[76] Inventor: Michael E. Lewis, 1089 Camelia St. NW., Hartville, Ohio 44632

[21] Appl. No.: 09/066,174

[22] Filed: Apr. 24, 1998

Related U.S. Application Data

[60] Provisional application No. 60/044,898, Apr. 25, 1997.

[51] Int. Cl.[7] ..... B01D 59/40

[52] U.S. Cl. ..... 307/95; 204/196; 205/729; 307/10.1; 439/938.1

[58] Field of Search ..... 307/9.1, 10.1, 307/95; 439/938.1; 204/196; 205/724, 729

[56] References Cited

U.S. PATENT DOCUMENTS

| | | | |
|---|---|---|---|
| 3,242,064 | 3/1966 | Byrne | 204/196 |
| 3,692,650 | 9/1972 | Kipps et al. | 205/729 |
| 4,767,512 | 8/1988 | Cowatch et al. | 307/95 |
| 5,102,514 | 4/1992 | McCready | 205/729 |

*Primary Examiner*—Richard T. Elms

*Attorney, Agent, or Firm*—Madan, Mossman & Sriram, P.C.

[57] ABSTRACT

An apparatus for prevention of corrosion in metal objects uses a pad having a conductive facing, a dielectric substrate and an adhesive, attached to a metal body being protected from corrosion. The metal body and the negative terminal of a source of DC voltage (battery) are grounded. The positive terminal of the source of DC voltage is connected to electronic circuitry that imparts pulses of low voltage DC to the conductive facing of the pad. These pulses of electrical current inhibit the oxidation of the metal object by providing a source of electrons to the oxidizing chemicals in contact with the metal. The electronic circuitry includes a reverse voltage protector to prevent the application of reverse source voltage. The circuitry also includes a power conditioner to supply a constant DC voltage to a microprocessor. The microprocessor generates pulses of DC signals that are amplified by a pulse amplifier and imparted to the conductive facing of the pad. The invention also includes a battery voltage monitor and a power indicator. When the battery voltage drops below a reference level, the microprocessor senses this low voltage condition and shuts off operation of the pulse amplifier, thereby conserving battery power.

25 Claims, 4 Drawing Sheets

PROCESS AND APPARATUS FOR PREVENTING OXIDATION OF METAL

CROSS REFERENCE TO RELATED APPLICATIONS

This application claims priority from United States Provisional patent application Ser. No. 60/044,898 filed on Apr. 25, 1997.

FIELD OF THE INVENTION

The present invention relates to the process and apparatus for prevention of oxidation of metal objects in an oxidizing environment. An oxidizing environment is characterized by the presence of at least one chemical, the atoms of which in that environment, are capable of being reduced by acquiring at least one electron from the atoms of the metal. In "donating" an electron, the metal becomes oxidized.

BACKGROUND OF THE INVENTION

In an oxidizing environment, there are substances that under suitable conditions, take up electrons and become reduced. These electrons come from the atoms of metal objects exposed to the oxidizing environment, which ends up being oxidized. As the process of oxidation continues, a metal object becomes degraded to the point that it can no longer be used for its intended purpose.

On land, oxidation is prevalent in, among other things, bridges and vehicles, when they are exposed to salt that is spread on roads to prevent the formation of ice in cold climates. The salt melts the snow and ice and, in so doing, forms an aqueous salt solution. The iron or steel in the bridges or vehicles, when exposed to the salt solution, is readily oxidized. The first visible sign of oxidation is the appearance of rust on the surface of the metal object. Continued oxidation leads to the weakening of the structural integrity of metal objects. If the oxidation is allowed to continue, the metal object rusts through and eventually disintegrates or, in the case of the metal in bridges, becomes too weak to sustain the load to which it is subjected. The situation has become worse in recent years with increased concentrations of pollutants and the demand for lighter, more fuel efficient vehicles requiring thinner sheet metal and the abandonment of mainframe construction.

The same aqueous salt solution is also the cause of corrosion in a marine environment and is responsible for the oxidation of hulls of ships, offshore pipelines, and drilling and production platforms used by the oil industry.

Early methods of corrosion prevention relied on applying a protective coating, for example of paint, to the metal object. This prevents the metal from coming in contact with the oxidizing environment and thereby prevents corrosion. Over a long time, however, the protective coating wears off and the process of oxidation of the metal could begin. The only way to prevent oxidation from starting is to reapply the coating. This can be an expensive process in the best of circumstances: it is a lot easier to thoroughly coat the parts of an automobile in a factory, before assembly, than to reapply the coating on an assembled automobile. In other circumstances, e.g., on an offshore pipeline, the process of reapplying a coating is impossible.

Other methods of prevention of oxidation include cathodic protection systems. In these, the metal object to be protected is made the cathode of an electrical circuit. The metal object to be protected and an anode is connected to a source of electrical energy, the electrical circuit being completed from the anode to the cathode through the aqueous solution. The flow of electrons provides the necessary source of electrons to the substances in the aqueous solution that normally cause oxidation, thereby reducing the "donation" of electrons coming from the atoms of the protected metal (cathode).

The invention of Byrne (U.S. Pat. No. 3,242,064) teaches a cathodic protection system in which pulses of direct current (DC) are supplied to the metal surface to be protected, such as the hull of a ship. The duty cycle of the pulses is changed in response to varying conditions of the water surrounding the hull of the ship. The invention of Kipps (U.S. Pat. No. 3,692,650) discloses a cathodic protection system applicable to well casings and pipelines buried in conductive soils, the inner surfaces of tanks that contain corrosive substances and submerged portions of structures. The system uses a short pulsed DC voltage and a continuous direct current.

The cathodic protection systems of prior art are not completely effective even for objects or structures immersed in a conductive medium such as sea water. The reason for this is that due to local variations in the shape of the structure being protected and to concentrations of the oxidizing substances in the aqueous environment, local "hot spots" of corrosion develop that are not adequately protected and, eventually, cause a breakdown of the structure. Cathodic protection systems are of little use in protecting metal objects that are not at least partially submerged in a conductive medium, such as sea water or conductive soil. As a result, metal girders of bridges and the body of automobiles are not protected by these cathodic systems.

Cowatch (U.S. Pat. No. 4,767,512) teaches a method aimed at preventing corrosion of objects that are not submerged in a conductive medium. An electric current is impressed into the metal object by treating the metal object as the negative plate of a capacitor. This is achieved by a capacitive coupling between the metal object and a means for providing pulses of direct current. The metal object to be protected and the means for providing pulses of direct current have a common ground. In a preferred embodiment of the invention, Cowatch discloses a device in which a DC voltage of 5,000 to 6,000 volts is applied to the positive plate of a capacitor separated from the metal object by a dielectric, and small, high frequency (1 kilohertz) pulses of DC voltage are superimposed on the steady DC voltage. Cowatch also refers to a puncture voltage of the dielectric material as about 10 kV.

Because of the safety hazards of having the high voltage applied at a place that exposes humans and animals to possible contact with the metal object or any other part of the capacitive coupling, Cowatch requires limitations on the maximum energy output of the invention.

The invention of Cowatch discloses a two-stage device for obtaining the pulsed DC voltage. The first stage provides outputs of a higher voltage AC and a lower voltage AC. In the second stage, the two AC voltages are rectified to give a high voltage DC with a superimposed DC pulse. The invention uses at least two transformers, one of which may be a push/pull saturated core transformer. Because of the use of transformers, the energy losses associated with the invention are high. Based on the disclosed values in the invention, the efficiency can be very low (less than 10%). The high heat dissipation may require a method of dissipating the heat. In addition, the invention requires a separate means for shutting off the device during prolonged periods of nonuse to avoid discharging the battery.

A somewhat related problem that affects submerged structures is caused by the growth of organisms. Mussels, for example, are a serious problem with municipal water supply systems and power plants. Because of their prolific growth, they clog the water intakes required for the proper operation of the water supply system or the power plant, causing a reduction in the flow of water. Expensive cleaning operations have to be carried out periodically. Barnacles and other organisms are well known for fouling the hulls of ships and other submerged parts of structures. Conventional means of dealing with this include the use of antifouling paints and thorough cleaning at regular intervals. The paints may have undesirable environmental effects while the cleaning is an expensive process, requiring that the ship be taken out of commission while the cleaning is done. Neither of these is effective in the long run.

It is a goal of the present invention to provide corrosion protection to metal objects even when the object to be protected is not immersed in an electrolyte. It is a further object of the present invention to accomplish this without exposing humans or animals to the risk of high voltages. In addition, the device should also be energy efficient, thereby reducing the drain on the power source and should not require any special means for heat dissipation. It also should, as part of the circuitry, have a battery voltage monitor that shuts off the pulse amplifier if the battery voltage drops below a predetermined threshold, thus conserving battery power. This is particularly useful because cold weather conditions under which corrosion is more likely due exposure to salt used to melt ice on roadways, also imposes greater demands on a battery for starting a vehicle. In addition to cold weather, high temperatures and humidity also lead to increased corrosion simultaneously with increased demands on battery power for starting a vehicle. It is also a goal of the present invention to inhibit the growth of organisms on submerged structures. Finally, it is also a goal of the present invention to protect the circuitry from damage if the apparatus is inadvertently connected to the battery with reversed polarity.

SUMMARY OF THE INVENTION

The present invention overcomes the problems of prior art and effectively prevents the oxidation of metal objects by capacitive coupling and passing pulses of direct current at a low voltage through the metal object. The metal object is treated as the negative plate of a capacitor. The apparatus used for providing the pulses of direct current is connected to the positive plate of the capacitor on one side, and to a ground, to which the metal object is also connected, on the other side. A dielectric material is interposed between the positive plate of the capacitor and the metal object. The paint on the metal object, if present, acts as an additional layer of dielectric material.

The pulses of direct current are produced by circuitry that includes a microprocessor, a reverse voltage protector, a pulse amplifier, a battery voltage monitor, a power indicator and a power conditioner to deliver pulses of direct current at a low voltage to the positive plate of the capacitor. Diodes, transistors, resistors, inductors and capacitors are used in the electronic circuit components; the circuitry does not include any transformers, thereby eliminating a major source of power loss.

In normal operation, when the exposed surface of the metal object is dry, the effective area of the capacitor is limited to the positive plate of the capacitor. When the surface of the metal is wet, or has a thin film of moisture on it, the presence of chemicals that have a sufficient reduction potential to acquire electrons from the metal increases the likelihood of oxidation and corrosion of the metal. These same chemicals that can cause corrosion also make the water or moisture film on the metal object electrically conductive; because of this, the effective area of the capacitor may increase from just the metal plate to the area covered by the electrically conductive water or film of moisture. The result of this increased capacitance is an increase in the current flowing through the circuit into the metal. Thus, the present invention is self-regulating in that the greater the possibility of corrosion, the greater the amount of protective current delivered to the metal.

The present invention is also effective, with little modification in inhibiting the growth of organisms, such as mussels and barnacles, on submerged structures.

DETAILED DESCRIPTION OF THE INVENTION

Figure 1:
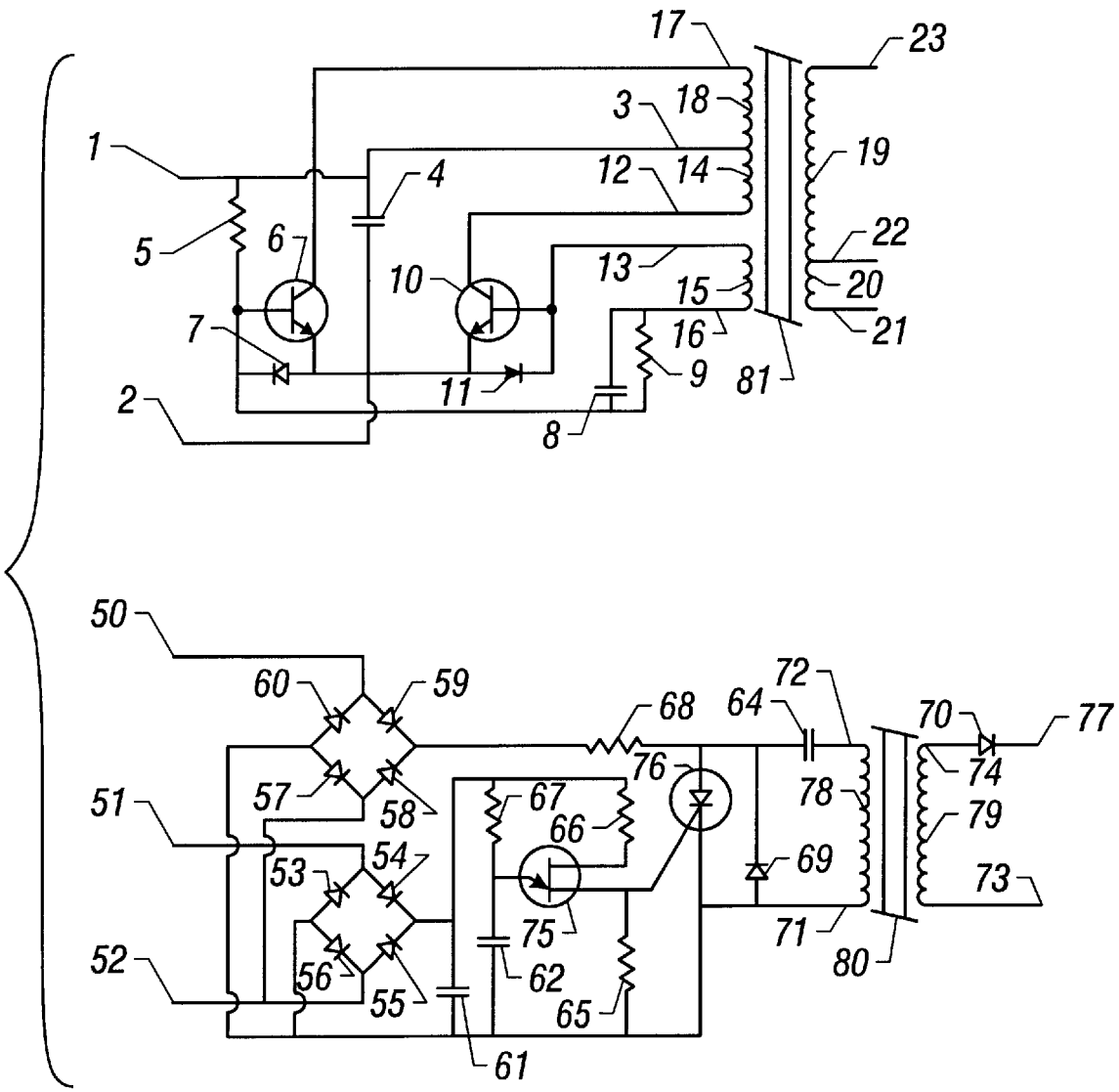
FIG. 1 (Prior Art)
FIG. 1 is a circuit diagram of the prior art of Cowatch.

The present invention is best understood by first referring to prior art methods of preventing oxidation of metal by capacitive coupling. The upper portion of FIG. 1 shows the circuit diagram of a push/pull saturated core transformer used in the invention of Cowatch. Terminal 1 is connected to the positive side of the electrical system of a vehicle and terminal 2 is connected to the negative side of the electrical system of the vehicle. The output of the transformer 81 has three taps, 21, 22 and 23. The tap 21 provides the system ground, 22 provides 12 volts AC and 23 provides 400 volts AC. The output from the first stage is fed to the second stage, a rectifier pulsator, the circuit diagram of which is shown in the bottom portion of FIG. 1. The 400 volt AC from 23 is fed to 50, the 12 volt AC from 22 is connected to 51 while the ground 21 is connected to 52. The output of the rectifier pulsator, between 77 and 73, is a 400 volts DC with 12 volts pulses superimposed on the 400 volts DC.

The prior art invention delivers a high voltage DC with low voltage pulses superimposed on the high voltage DC to a positive plate of a capacitor connected between 73 and 77. The positive plate of the capacitor is separated from and coupled to the grounded metal object by means of a capacitive pad.

Figure 2:
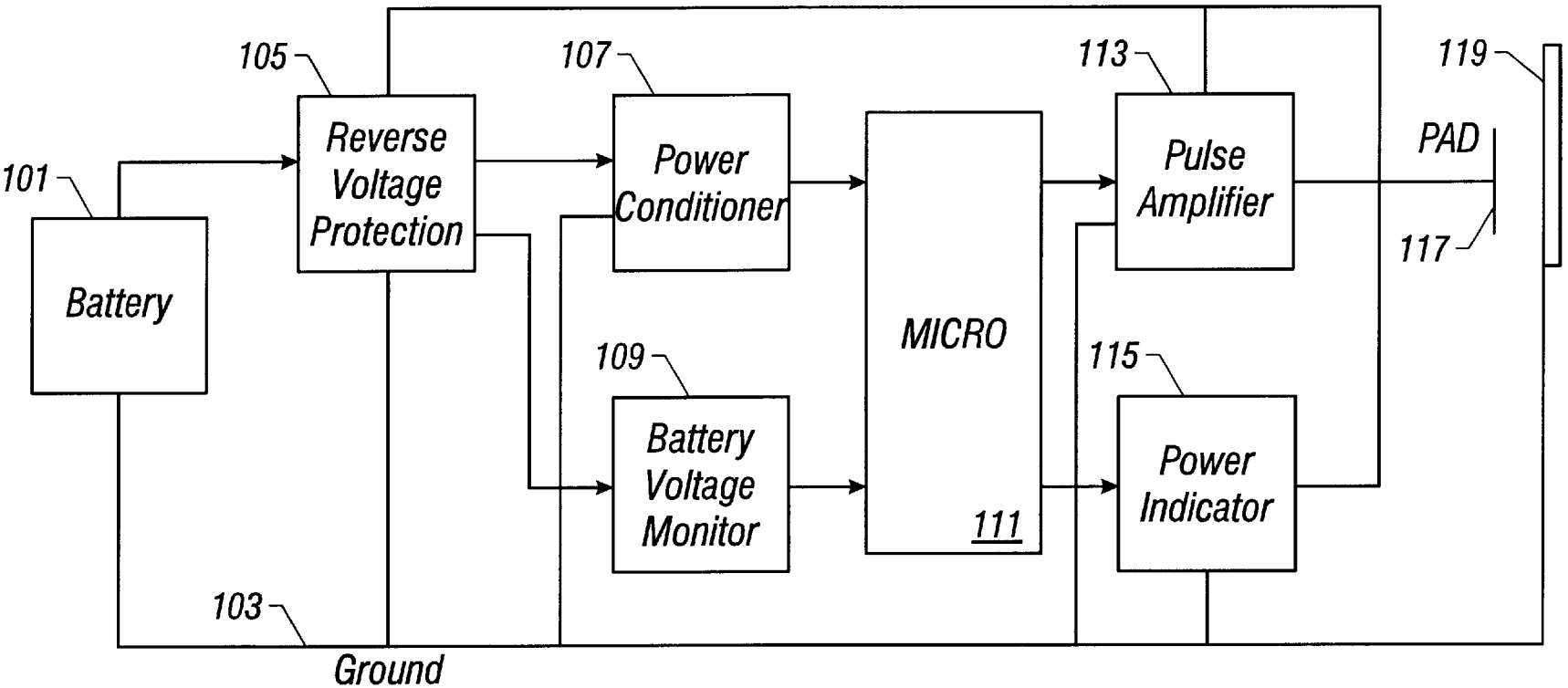
FIG. 2 is a schematic diagram of the apparatus of the present invention.

FIG. 2 is a functional block diagram illustrating the operation of the apparatus of the present invention. The battery 101 is the source of DC power for the invention. One terminal of the battery is connected to the ground, 103. The positive terminal of the battery is connected to the Reverse Voltage Protector, 105. The reverse voltage protector prevents application of reverse battery voltage from being inadvertently applied to the other circuitry and damaging the components.

The Power Conditioner, 107, converts the battery voltage to the proper voltage needed by the microprocessor, 111. In the preferred embodiment, the voltage needed by the microprocessor is 5.1 volts DC. The battery voltage monitor, 109, compares the battery voltage with a reference voltage (12 volts DC in the preferred embodiment). If the battery voltage is above the reference voltage, then the microprocessor 111, activates the pulse amplifier, 115, and the power indicator, 115. When the pulse amplifier is activated by a pulse signal having a positive output of the microprocessor, an amplified pulse signal having a positive output is generated by the pulse amplifier and conveyed to the pad, 117. The pad, 117, is capacitively coupled to the metal object being protected, 119. When the power indicator 115 is activated, a power LED in the power indicator is turned on, serving as an indicator that the pulse amplifier has been activated. The use of the battery voltage monitor 109 prevents drain on the battery if the battery voltage is too low.

When the present invention is used to protect a metal object, such as the body of an automobile, the pad 117 has a substrate material similar to thin fiber glass and is attached to the object 119 by means of a high dielectric strength silicone adhesive. In the preferred embodiment, the substrate-adhesive combination has a breakdown potential of at least 10 kilovolts. The adhesive is preferably a fast curing one, which will cure sufficiently in 15 minutes to secure the dielectric material to the metal object.

Figure 3A:
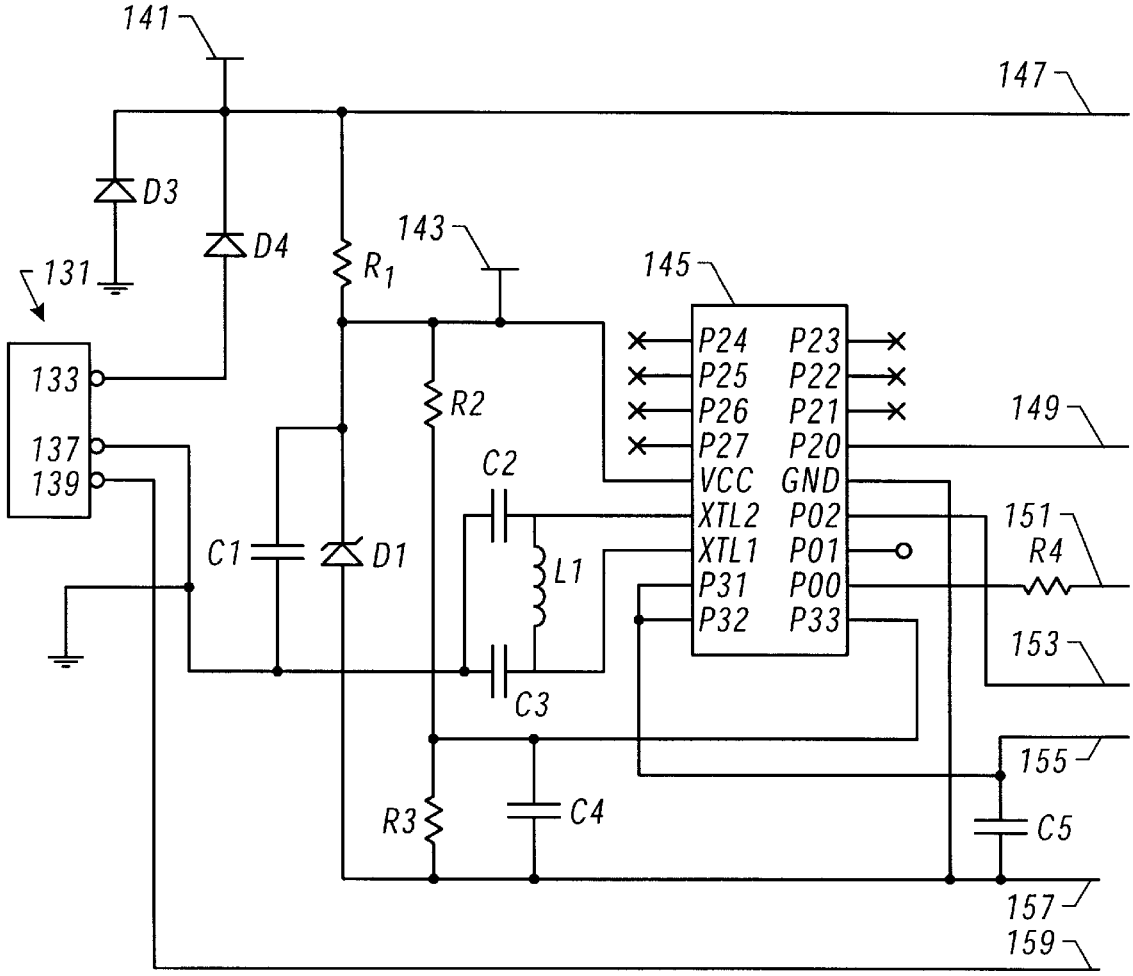
FIGS. 3A, 3B and 3C are circuit diagrams of the preferred embodiment of the present invention.
Figure 3B:
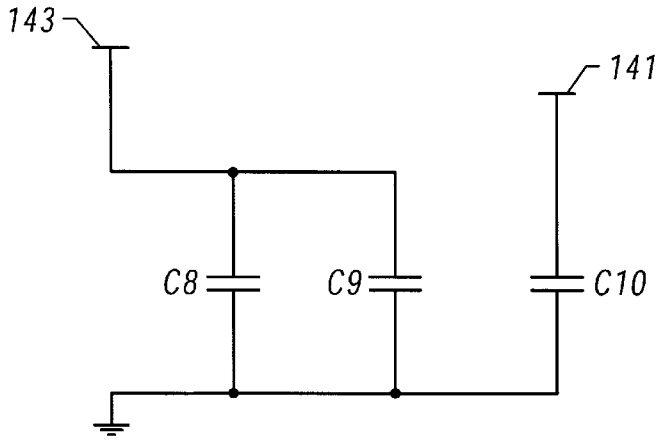
Figure 3C:
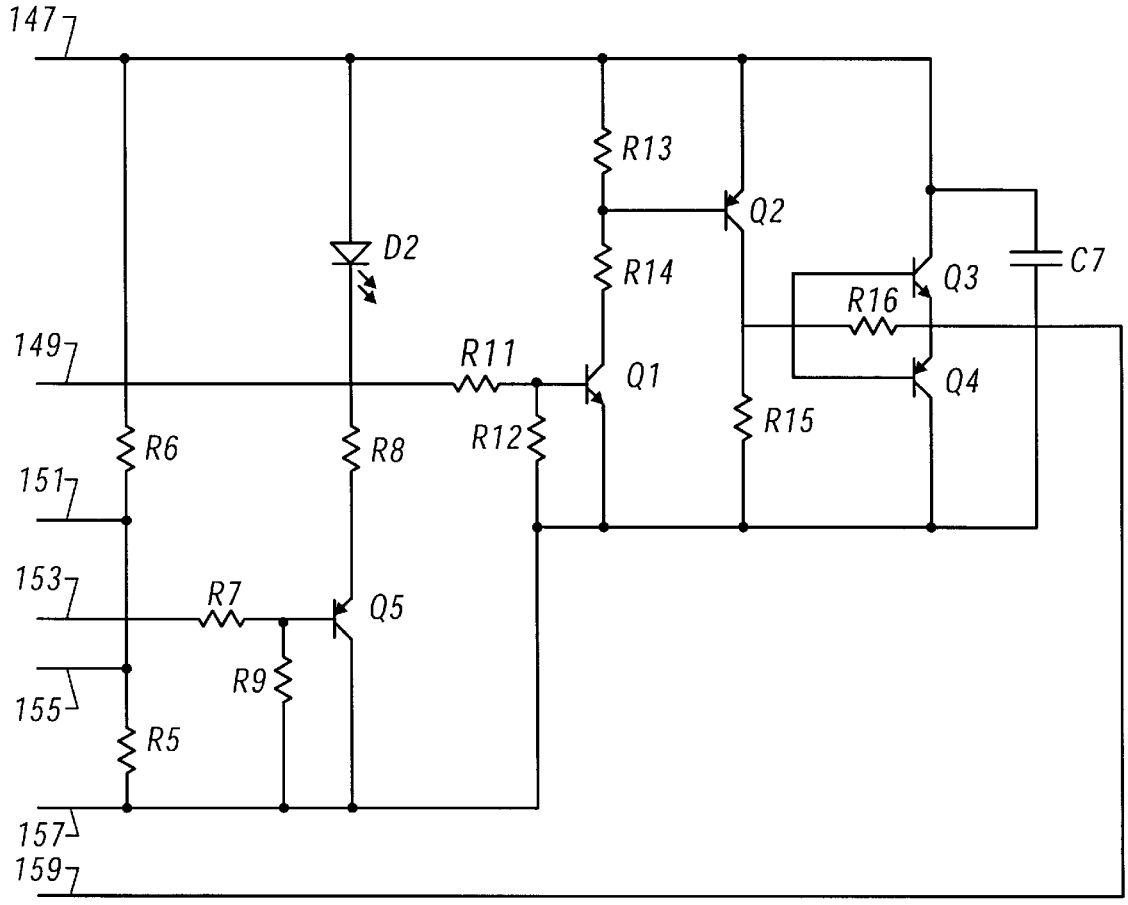

With the broad overview of the invention in FIG. 2, the details of the device, shown in FIGS. 3A–3C are easier to understand. The unit is powered from a typical car battery in which the positive terminal of the battery is connected to 133 on a connector panel 131. The negative terminal of the battery is connected to the body of the car (the "ground") and to 137 on the connector panel 131. The pad 117 from FIG. 2 is connected to 139 on the connector panel 131 while the metal object being protected, 119 in FIG. 2, is connected to the ground. The car battery, the pad 117 and the metal object being protected, 119, and their connections are not shown in FIG. 3A.

The reverse voltage protection circuit 105 of FIG. 2 comprises of the diodes D3 and D4 in FIG. 3A. In the preferred embodiment of the invention, D3 and D4 are IN4004 diodes. Those who are familiar with the art would recognize that with the configuration of the diodes as shown, the voltage at the point 141 will not be at a negative voltage with respect to the ground even if the battery is connected to the connector board 131 with reversed polarity. This protects the electronic components from damage and is an improvement over prior art.

The power conditioner circuit, 107 in FIG. 2, is made of resistor R1, Zener diode D1 and capacitor C1. These convert the nominal battery voltage of 13.5 volts to the 5.1 volts needed by the microprocessor. In the preferred embodiment, R1 has a resistance of 330 Ω, C1 has a capacitance of 0.1 μF and D1 is an IN751 diode. As would be known to those familiar with the art, a Zener diode has a highly stable reference voltage across the diode for a wide range of current through the diode.

Capacitors C8, C9 and C10 serve the function of filtering the battery voltage and the reference voltage. In the preferred embodiment, they each have a value of 0.1 μF. C8 and C9 could be replaced by a single capacitor with a value of 0.2 μF.

The battery voltage monitor comprises of resistors R2, R3, R4, R5 and R6 and capacitors C4 and C5. The voltage is monitored by a comparator in the microprocessor 145. The voltage divider, comprising of resistors R2 and R3, provides a stable reference to the pin P33 of the microprocessor 145. In the preferred embodiment, R2 and R3 each have a resistance of 100 KΩ. Accordingly, with the reference voltage of the Zener diode D1 of 5.1 volts, the voltage at pin P33 of the microprocessor would be 2.55 volts. In the preferred embodiment, the microprocessor 145 is a Z86ED4M manufactured by ZIlog.

The battery voltage is divided by the resistors R5 and R6 and applied to the comparator input pins P31 and P32. In the preferred embodiment, R5 has a resistance of 180K and R6 has a resistance of 100 KΩ. The comparator in the microprocessor 145 compares the battery voltage divided by R5 and R6, at pins P31 and P32, with the divided reference of 2.55 volts at pin P33. Whenever the voltage at pins P31 and P32 drops below the reference voltage at pin P33, microprocessor senses a low battery voltage and stops sending signals to the pulse amplifier (discussed below). The necessity for connecting pin P00 to the junction of resistors R5 and R6 through resistor R4 arises because the comparator is responsive only to transitions wherein the voltage at pins P31 and P32 drops below the reference voltage at pin P33. The pin P00 is pulsed approximately every one second or so between 0 volts and 5 volts by the microprocessor. When the pin P00 is at zero volts, then with a resistance of 100 KΩ for resistor R4 in the preferred embodiment, the voltage at pins P31 and P32 is below the 2.55 volts reference voltage at pin P33 when the battery voltage is below 11.96 volts. When the pin P00 is at 5 volts, the voltage at P31 and P32 is above 2.55 volts. By this means, the microprocessor is able to sense a low battery voltage in continuous operation. Capacitors C4 and C5 provide AC filtering for these voltages.

Those familiar with the art would recognize that the requirement for cycling pin P00 between two voltage levels, and the requirement for resistor R4, would not be necessary in other microprocessors in which the comparator may be responsive to actual differences between a reference voltage and a battery voltage, rather than to a transition of the battery voltage below the reference voltage.

The use of a microprocessor to generate pulses of DC voltage and the use of a battery voltage monitor to shut down the apparatus when the battery voltage drops below a reference level are improvements over prior art methods.

The Power Indicator comprises of an LED D2, transistor Q5 and resistors R7, R8 and R9. The transistor Q5 is driven on by a positive output of the microprocessor at pin P02. When the transistor Q5 is on, the LED D2 is lit. If the battery voltage is reduced to a nominal 12 V, the microprocessor does not have a positive output at pin P02 and the LED D2 is turned off . When the battery voltage rises above a nominal 12 volts, the microprocessor has a positive output on pin P02 and the LED D2 is turned on.

In the preferred embodiment, Q5 is a 2N3904 transistor, R7 has a resistance of 3.9 KΩ, R8 has a resistance of 1 KΩ and R9 has a resistance of 10 KΩ.

When the battery voltage is above the nominal 12 V, the microprocessor also produces an output pulse on pin P20. This is sent to the Pulse Amplifier, comprising of resistors R11–R16 and transistors Q1–Q4. In the preferred embodiment, Q1, Q3 and Q5 are 2N3904 transistors, Q2 and Q4 are 2N2907 transistors; R11 has a resistance of 2.7 KΩ, R12 and R13 each have a resistance of 1 KΩ, R14 and R15 have resistances of 390 Ω, and R16 has a resistance of 1 KΩ. The capacitor C7 provides AC filtering for the pulse amplifier circuit and, in the preferred embodiment, has a capacitance of 20 μF. The output of the pulse amplifier is applied, through 139 in the connector panel 131, to the coupling pad 117 that is attached to the car body. The output has a nominal amplitude of 12 volts.

With the complete absence of any transformers in the invention, high efficiency can be readily achieved. This reduces the drain on the battery and is an improvement over prior art.

In the preferred embodiment, the signal from pin P20 of the microprocessor comprises of a 5 V, 3.5 μs wide pulse that occurs at a nominal 11 kHz repetition rate. A range of pulse durations between 1 μs and 10.0 μs has been found to be satisfactory. A repetition rate of between 5 kHz and 50 kHz has been found to be acceptable. An pair of important parameters are the rise and fall times of the amplified pulse signal that is applied to the pad 117. In the preferred embodiment, the rise time and the fall time of each pulse that forms the amplified pulse signal are both less than 200 nanoseconds.

The clock for the microprocessor in the preferred embodiment is the resonant circuit comprising of capacitors C2 and C3 and the inductor L1. Use of this circuit is more cost effective than a quartz crystal for controlling the microprocessor clock. This is an improvement over prior art. In the preferred embodiment, C2 and C3 have a capacitance of 100 pF while the inductor L1 has an inductance of 8.2 $\mu$H. Those familiar with the art would recognize that other devices or circuits could be used to provide the timing mechanism for the microprocessor.

The foregoing is intended to be a description of the preferred embodiment of the invention. Variations of the disclosed embodiment may be easily made and are intended to be within the scope of the invention.

What I claim is:

1. An apparatus for prevention of oxidation of a metal object connected to an electrical ground, said metal object being in an oxidizing environment, comprising:

(a) a source of DC voltage connected to the ground, said source having a first voltage;

(b) a pad capacitively coupled to the metal object;

(c) a pulse amplifier coupled to the pad, said pulse amplifier adapted to provide an amplified pulsed signal thereto upon provision of a pulsed signal; and (d) a microprocessor operatively coupled to the source of DC voltage and to the pulse amplifier, the microprocessor providing the pulsed signal to the pulse amplifier.

2. The apparatus of claim 1 further comprising a voltage monitor coupled to the source of DC voltage wherein the voltage monitor provides a difference signal to the microprocessor indicative of the difference between the first voltage and a reference voltage.

3. The apparatus of claim 2 wherein the microprocessor further provides the pulsed signal when the difference signal is greater than zero.

4. The apparatus of claim 1 further comprising a power conditioner interposed between the source of DC voltage and the microprocessor, said power conditioner converting the first voltage to a second voltage needed by the microprocessor.

5. The apparatus of claim 1 wherein the pad further comprises a metal foil and an insulating substrate between the metal foil and the metal object.

6. The apparatus of claim 1 wherein the substrate is attached to the metal object by an adhesive having, the combination of the substrate and adhesive having a breakdown potential greater than 10 kV.

7. The apparatus of claim 1 wherein the amplified pulsed signal has a voltage less than 12 volts.

8. The apparatus of claim 1 wherein the pulsed signal comprises pulses having a duration of between 1.0 and 10.0 microseconds.

9. The apparatus of claim 8 wherein the pulses have a repetition rate of between 5 kHz and 50 kHz.

10. The apparatus of claim 1 further comprising a resonant circuit for providing a clock signal to the microprocessor.

11. The apparatus of claim 1 wherein the source of DC voltage is a car battery.

12. The apparatus of claim 1 further comprising a reverse voltage protector for protecting the apparatus from a reverse source voltage.

13. The apparatus of claim 1 wherein the pulsed signal comprises pulses having a rise time and a fall time, each of said times being less than 200 nanoseconds.

14. A method for alleviation of oxidation of a metal object in an oxidizing environment comprising;

(a) connecting the metal object to an electrical ground;

(b) connecting a source of DC voltage having a first voltage to the ground;

(c) capacitively coupling a pad to the metal object;

(d) operatively coupling a microprocessor to the source of DC voltage and to a pulse amplifier, (e) using the microprocessor to provide a pulsed signal to the pulse amplifier;

(f) amplifying the pulsed signal with the pulse amplifier; and (g) providing the amplified pulses to the pad.

15. The method of claim 14 wherein the amplified pulsed signal has a voltage less than 6 volts.

16. The method of claim 14 wherein the pulsed signal comprises DC pulses having a duration of between 1.0 and 10.0 microseconds.

17. The method of claim 14 further comprising using a reverse voltage protector to prevent the application of reverse source voltage to the ground.

18. The method of claim 14 further comprising using a voltage monitor to provide to the microprocessor a signal indicative of the difference between the first voltage and a reference voltage.

19. The method of claim 14 further comprising using a resonant circuit for providing a clock signal to the microprocessor.

20. The method of claim 14 further comprising interposing a power conditioner between the source of DC voltage and the microprocessor to convert the first voltage to a second voltage needed by the microprocessor.

21. The method of claim 14 wherein the capacitive coupling is provided by using an insulating substrate between a metal foil connected to the pulse amplifier and the metal object.

22. An apparatus for prevention of oxidation of a metal object connected to an electrical ground, said metal object being in an oxidizing environment, comprising:

(a) a source of DC voltage connected to the ground, said source having a first voltage;

(b) a pad capacitively coupled to the metal object;

(c) a pulse amplifier coupled to the pad, said pulse amplifier adapted to provide an amplified pulsed signal thereto upon provision of a pulsed signal; and (d) a microprocessor operatively coupled to the source of DC voltage and to the pulse amplifier, the microprocessor providing the pulsed signal to the pulse amplifier wherein the pulsed signal comprises pulses having a duration of between 1.0 and 10.0 microseconds.

23. The apparatus of claim 22 wherein the pulses have a repetition rate of between 5 kHz and 50 kHz.

24. The apparatus of claim 22 wherein the pulsed signal comprises pulses having a rise time and a fall time, each of said time being less than 200 nanoseconds.

25. A method for alleviation of oxidation of a metal object in an oxidizing environment comprising;

(a) connecting the metal object to an electrical ground;

(b) connecting a source of DC voltage having a first voltage to the ground;

(c) capacitively coupling a pad to the metal object;

(d) operatively coupling a microprocessor to the source of DC voltage and to a pulse amplifier, (e) using the microprocessor to provide a pulsed signal to the pulse amplifier wherein the pulsed signal comprises DC pulses having a duration of between 1.0 and 10.0 microseconds;

(f) amplifying the pulsed signal with the pulse amplifier; and (g) providing the amplified pulses to the pad.

* * * * *